US006146758A

United States Patent [19]

Gownder et al.

[11] Patent Number: 6,146,758

[45] Date of Patent: Nov. 14, 2000

[54] POLYPROPYLENE FIBERS

[75] Inventors: Mohan R. Gownder, La Porte; Eduardo E. Zamora, Bellaire; Jay Nguyen, Pasadena, all of Tex.

[73] Assignee: Fina Technology, Inc., Dallas, Tex.

[21] Appl. No.: 09/303,728

[22] Filed: May 3, 1999

Related U.S. Application Data

[62] Division of application No. 08/936,254, Sep. 24, 1997, Pat. No. 5,908,594.

[51] Int. Cl.[7] ..... D01F 6/06

[52] U.S. Cl. ..... 428/364; 428/394

[58] Field of Search ..... 428/364, 394

[56] References Cited

U.S. PATENT DOCUMENTS

| | | | |
|---|---|---|---|
| 4,384,098 | 5/1983 | Hagler et al. | 526/348.1 |
| 5,637,666 | 6/1997 | Winter et al. | 526/351 |
| 5,668,235 | 9/1997 | Winter et al. | 526/351 |
| 5,868,984 | 2/1999 | Winter et al. | 264/176.1 |

FOREIGN PATENT DOCUMENTS

| | | |
|---|---|---|
| 0600461 | 12/1993 | European Pat. Off. . |
| 9413713 | 6/1994 | WIPO . |
| 9530708 | 11/1995 | WIPO . |

*Primary Examiner*—Newton Edwards
*Attorney, Agent, or Firm*—William D. Jackson; Jim D. Wheelington; M. Norwood Cheairs

[57] ABSTRACT

Process for the production of polypropylene fibers from polypropylene polymers produced by the polymerization of polypropylene in the presence of a metallocene catalyst characterized by a bridged racemic bis(indenyl) ligand substituted at the proximal position. The polypropylene contains 0.5 to 2% 2,1 insertions and has an isotacticity of at least 95% meso diads and is heated to a molten state and extruded to form a fiber preform. The preform is subjected to spinning at a spinning speed of at least 500 meters per minutes and subsequent drawing at a speed of at least 1,500 meters per minute to provide a draw ratio of at least 3 to produce a continuous polypropylene fiber. The draw speed and/or the draw ratio can be varied to produce fibers of different mechanical properties. Different polypropylene polymers produced by different metallocene catalysts can be used. Such fibers can be characterized by having an elongation at break of at least 100% and a specific toughness of at least 0.5 grams per denier.

6 Claims, 5 Drawing Sheets

POLYPROPYLENE FIBERS

This application is a division of pending prior application Ser. No. 08/936,254, filed Sep. 24, 1997, now U.S. Pat. No. 5,908,594.

FIELD OF THE INVENTION

This invention relates to polypropylene fibers and, more particularly, to such fibers and processes for their preparation from metallocene-based isotactic polypropylene.

BACKGROUND OF THE INVENTION

Isotactic polypropylene is one of a number of crystalline polymers which can be characterized in terms of the stereoregularity of the polymer chain. Various stereospecific structural relationships, characterized primarily in terms of syndiotacticity and isotacticity, may be involved in the formation of stereoregular polymers for various monomers. Stereospecific propagation may be applied in the polymerization of ethylenically-unsaturated monomers, such as $C_3$ +alpha olefins, 1-dienes such as 1,3-butadiene, substituted vinyl compounds such as vinyl aromatics, e.g. styrene or vinyl chloride, vinyl chloride, vinyl ethers such as alkyl vinyl ethers, e.g, isobutyl vinyl ether, or even aryl vinyl ethers. Stereospecific polymer propagation is probably of most significance in the production of polypropylene of isotactic or syndiotactic structure.

Isotactic polypropylene is conventionally used in the production of fibers in which the polypropylene is heated and then extruded through one or more dies to produce a fiber preform which is processed by a spinning and drawing operation to produce the desired fiber product. The structure of isotactic polypropylene is characterized in terms of the methyl group attached to the tertiary carbon atoms of the successive propylene monomer units lying on the same side of the main chain of the polymer. That is, the methyl groups are characterized as being all above or below the polymer chain. Isotactic polypropylene can be illustrated by the following chemical formula:

(1)

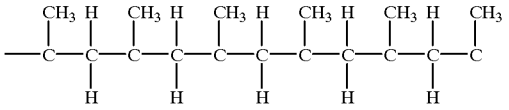

Stereoregular polymers, such as isotactic and syndiotactic polypropylene, can be characterized in terms of the Fisher projection formula. Using the Fisher projection formula, the stereochemical sequence of isotactic polypropylene, as shown by Formula (2), is described as follows:

(2)

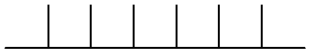

Another way of describing the structure is through the use of NMR. Bovey's NMR nomenclature for an isotactic pentad is . . . mmmm . . . with each "m" representing a "meso" dyad, or successive methyl groups on the same side of the plane of the polymer chain. As is known in the art, any deviation or inversion in the structure of the chain lowers the degree of isotacticity and crystallinity of the polymer.

In contrast to the isotactic structure, syndiotactic propylene polymers are those in which the methyl groups attached to the tertiary carbon atoms of successive monomeric units in the polymer chain lie on alternate sides of the plane of the polymer. Using the Fisher projection formula, the structure of syndiotactic polypropylene can be shown as follows:

(3)

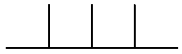

The corresponding syndiotactic pentad is rrrr with each r representing a racemic diad. Syndiotactic polymers are semi-crystalline and, like the isotactic polymers, are insoluble in xylene. This crystallinity distinguishes both syndiotactic and isotactic polymers from an atactic polymer, which is non-crystalline and highly soluble in xylene. An atactic polymer exhibits no regular order of repeating unit configurations in the polymer chain and forms essentially a waxy product. Catalysts that produce syndiotactic polypropylene are disclosed in U.S. Pat. No. 4,892,851. As disclosed there, the syndiospecific metallocene catalysts are characterized as bridged structures in which one Cp group is sterically different from the others. Specifically disclosed in the '851 patent as a syndiospecific metallocene is isopropylidene(cyclopentadienyl-1-fluorenyl) zirconium dichoride.

In most cases, the preferred polymer configuration will be a predominantly isotactic or syndiotactic polymer with very little atactic polymer. Catalysts that produce isotactic polyolefins are disclosed in U.S. Pat. Nos. 4,794,096 and 4,975,403. These patents disclose chiral, stereorigid metallocene catalysts that polymerize olefins to form isotactic polymers and are especially useful in the polymerization of highly isotactic polypropylene. As disclosed, for example, in the aforementioned U.S. Pat. No. 4,794,096, stereorigidity in a metallocene ligand is imparted by means of a structural bridge extending between cyclopentadienyl groups. Specifically disclosed in this patent are stereoregular hafnium metallocenes which may be characterized by the following formula:

$$R''(C_5(R')_4)_2HfQp \quad (4)$$

In Formula (4), $(C_5(R')_4)$ is a cyclopentadienyl or substituted cyclopentadienyl group, R' is independently hydrogen or a hydrocarbyl radical having 1–20 carbon atoms, and R" is a structural bridge extending between the cyclopentadienyl rings. Q is a halogen or a hydrocarbon radical, such as an alkyl, aryl, alkenyl, alkylaryl, or arylalkyl, having 1–20 carbon atoms and p is 2.

Metallocene catalysts, such as those described above, can be used either as so-called "neutral metallocenes" in which case an alumoxane, such as methylalumoxane, is used as a co-catalyst, or they can be employed as so-called "cationic metallocenes" which incorporate a stable non-coordinating anion and normally do not require the use of an alumoxane. For example, syndiospecific cationic metallocenes are disclosed in U.S. Pat. No. 5,243,002 to Razavi. As disclosed there, the metallocene cation is characterized by the cationic metallocene ligand having sterically dissimilar ring structures which are joined to a positively-charged coordinating transition metal atom. The metallocene cation is associated with a stable non-coordinating counter-anion. Similar relationships can be established for isospecific metallocenes.

Catalysts employed in the polymerization of alpha-olefins may be characterized as supported catalysts or as unsupported catalysts, sometimes referred to as homogeneous catalysts. Metallocene catalysts are often employed as unsupported or homogeneous catalysts, although, as described below, they also may be employed in supported catalyst components. Traditional supported catalysts are the so-called "conventional" Ziegler-Natta catalysts, such as titanium tetrachloride supported on an active magnesium dichloride, as disclosed, for example, in U.S. Pat. Nos. 4,298,718 and 4,544,717, both to Myer et al. A supported catalyst component, as disclosed in the Myer '718 patent, includes titanium tetrachloride supported on an "active" anhydrous magnesium dihalide, such as magnesium dichloride or magnesium dibromide. The supported catalyst component in Myer '718 is employed in conjunction with a co-catalyst such and an alkylaluminum compound, for example, triethylaluminum (TEAL). The Myer '717 patent discloses a similar compound which may also incorporate an electron donor compound which may take the form of various amines, phosphenes, esters, aldehydes, and alcohols.

While metallocene catalysts are generally proposed for use as homogeneous catalysts, it is also known in the art to provide supported metallocene catalysts. As disclosed in U.S. Pat. Nos. 4,701,432 and 4,808,561, both to Welborn, a metallocene catalyst component may be employed in the form of a supported catalyst. As described in the Welborn '432 patent, the support may be any support such as talc, an inorganic oxide, or a resinous support material such as a polyolefin. Specific inorganic oxides include silica and alumina, used alone or in combination with other inorganic oxides such as magnesia, zirconia and the like. Non-metallocene transition metal compounds, such as titanium tetrachloride, are also incorporated into the supported catalyst component. The Welborn '561 patent discloses a heterogeneous catalyst which is formed by the reaction of a metallocene and an alumoxane in combination with the support material. A catalyst system embodying both a homogeneous metallocene component and a heterogeneous component, which may be a "conventional" supported Ziegler-Natta catalyst, e.g. a supported titanium tetrachloride, is disclosed in U.S. Pat. No. 5,242,876 to Shamshoum et al. Various other catalyst systems involving supported metallocene catalysts are disclosed in U.S. Pat. No. 5,308,811 to Suga et al and U.S. Pat. No. 5,444,134 to Matsumoto.

The polymers normally employed in the preparation of drawn polypropylene fibers are normally prepared through the use of conventional Ziegler-Natta catalysts of the type disclosed, for example, in the aforementioned patents to Myer et al. U.S. Pat. No. 4,560,734 to Fujishita and U.S. Pat. No. 5,318,734 to Kozulla disclose the formation of fibers by heating, extruding, melt spinning, and drawing from polypropylene produced by titanium tetrachloride-based isotactic polypropylene. Particularly, as disclosed in the patent to Kozulla, the preferred isotactic polypropylene for use in forming such fibers has a relatively broad molecular weight distribution (abbreviated MWD), as determined by the ratio of the weight average molecular weight ($M_w$) to the number average molecular ($M_n$) of about 5.5 or above. Preferably, as disclosed in the Kozulla patent, the molecular weight distribution, $M_w/M_n$, is at least 7.

It is also known to produce polypropylene-based fibers from syndiotactic polypropylene. Thus, as disclosed in U.S. Pat. No. 5,272,003 to Peacock, syndiotactic polypropylene, such as that produced by syndiospecific metallocenes of the type disclosed in the aforementioned U.S. Pat. No. 4,892,851, can be used to produce polypropylene fibers using various techniques disclosed therein and identified as melt spinning, solution spinning, flat film spinning, blown film, and melt blowing or spunbond procedures. As disclosed in Peacock, the syndiotactic polypropylene, as characterized by polymer configuration, comprises racemic diads connected predominantly by meso triads. As noted in Peacock, the syndiotactic polypropylene fibers may be in the form of continuous filament yarn, monofilaments, staple fiber, tow, or top. Syndiotactic fibers, as thus produced, are characterized as having substantially greater retraction value than fibers formed of isotactic polypropylene. This enhanced elasticity is said to form an advantage of the syndiotactic polypropylene fibers over isotactic polypropylene fibers for use in garments, carpets, tie downs, tow ropes, and the like.

SUMMARY OF THE INVENTION

In accordance with the present invention, there is provided an elongated fiber product comprising a drawn polypropylene fiber formed from an isotactic polypropylene containing at least 0.5% 2,1 insertions prepared by the polymerization of polypropylene in the presence of a metallocene catalyst characterized by the formula:

$$\text{rac-R'R''Si(2-RiInd)}_2\text{MeQ}_2 \quad (5)$$

In Formula (5), R' and R" are each independently a $C_1$–$C_4$ alkyl group or an phenyl group; Ind is an indenyl group or a hydrogenated indenyl group substituted at the proximal position by the substituent $R_i$ and being otherwise unsubstituted or being substituted at 1 or 2 of the 4, 5, 6, and 7 positions; $R_i$ is a ethyl, methyl, isopropyl, or tertiary butyl group; Me is a transition metal selected from the group consisting of titanium, zirconium, hafnium, and vanadium; and each Q is independently a hydrocarbyl group containing 1 to 4 carbon atoms or a halogen. The fiber is prepared by spinning and drawing at a draw speed of at least 3,000 and a draw ratio within the range of 2–5 (preferably at least 3) and is further characterized by having an elongation at break of at least 100% and a specific toughness of at least 0.5 grams per denier.

In a further aspect of the invention there is provided a process for the production of polypropylene fibers. In carrying out the process, there is provided a polypropylene polymer produced by the polymerization of polypropylene in the presence of a metallocene catalyst characterized by Formula (5) above. The polypropylene contains 0.5 to 2%, preferably at least 1%, 2,1 insertions and has an isotacticity of at least 95% meso diads. The polymer is heated to a molten state and extruded to form a fiber preform. The preform is subjected to spinning at a spinning speed of at least 500 meters per minutes and subsequent drawing at a speed of at least 1,500 meters per minute to provide a draw ratio of at least 3 to produce a continuous polypropylene fiber.

In yet a further embodiment of the invention, there is provided a process for the production of polypropylene fibers in which the draw speed and/or the draw ratio can be varied to produce fibers of different mechanical properties. In this aspect of the invention, there is provided a polypropylene polymer comprising isotactic polypropylene containing at least 0.5% 2,1 insertions and having an isotacticity of at least 95% meso diads and produced by the polymerization of polypropylene in the presence of an isospecific metallocene catalyst characterized as having a bridged bis (indenyl) ligand in which the indenyl ligand is an enantiomorphic and may be substituted or unsubstituted. The polypropylene is heated to a molten state and extruded to produce a fiber preform which is then spun at a spinning speed of at least 500 meters per minute and subsequently drawn at a spinning speed of 1,500 meters per minute at a draw ratio of at least 2 to provide a continuous fiber of a desired physical characteristic. The process involves continuing to provide a polypropylene polymer produced by the polymerization of polypropylene in the presence of an isospecific metallocene catalyst and heating the polymer to produce a fiber preform which is subjected to spinning under a spinning speed of at least 500 meters per minute with subsequent drawing at a speed of 1,500 meters per minute to provide a draw ratio of at least 2. The draw speed here is different from the draw speed initially provided to change the mechanical property of the continuous polypropylene polymer. In a further aspect of the invention, the second polypropylene polymer is produced by a different metallocene catalyst than the initial polypropylene polymer.

DETAILED DESCRIPTION OF THE INVENTION

Figure 1:
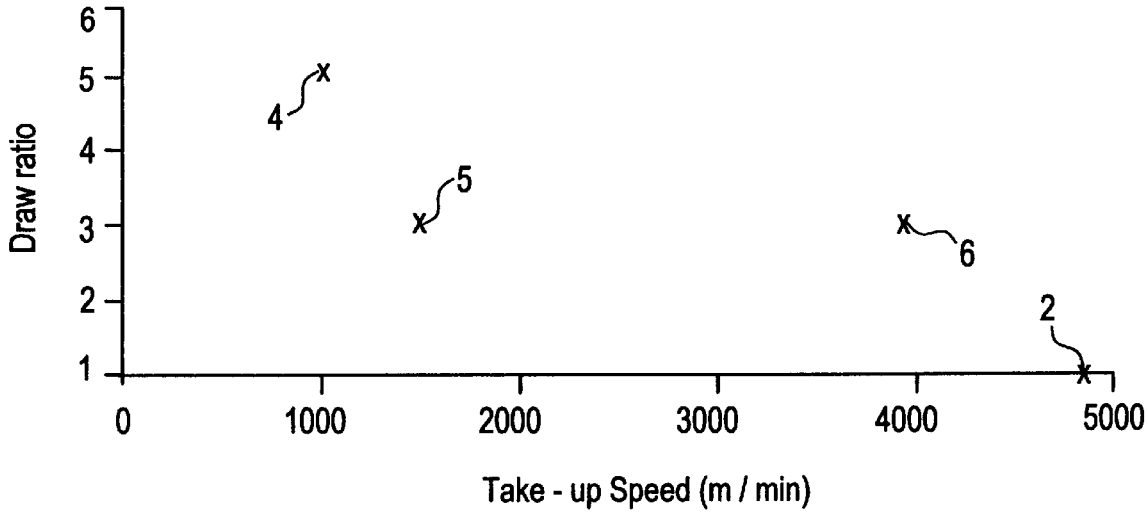
FIG. 1 is a plot of draw ratio on the ordinate versus draw speed on the abscissa showing various fiber properties at different spinning and drawing conditions.

The fiber products of the present invention are formed using a particularly-configured polyolefin polymer, as described in greater detail below, and by using any suitable melt spinning procedure, such as the Fourne fiber spinning procedure. The use of isospecific metallocene catalysts in accordance with the present invention provides for isotactic polypropylene structures which can be correlated with desired fiber characteristics, such as strength, toughness, and in terms of the draw speed and draw ratios employed during the fiber-forming procedure.

The fibers produced in accordance with the present invention can be formed by any suitable melt spinning procedure, such as the Fourne melt spinning procedure, as will be understood by those skilled in the art in using a Fourne fiber spinning machine. The polypropylene is passed from a hopper through a heat exchanger where the polymer pellets are heated to a suitable temperature for extrusion, about 180–280° C. for the metallocene-based polypropylene used here, and then through a metering pump to a spin extruder. The fiber preforms thus formed are cooled in air then applied through one or more godets to a spinning role which is operated at a desired spinning rate, about 500–1500 meters per minute, in the present invention. The thus-formed filaments are drawn off the spin role to the drawing roller which is operated at a substantially-enhanced speed in order to produce the drawn fiber. The draw speed normally will range from about 2,000–4,000 meters per minute and is operated relative to the spinning godet to provide the desired draw ratio normally within the range of 2:1 to 5:1. For a further description of suitable fiber-spinning procedures for use in the present invention, reference is made to the aforementioned U.S. Pat. No. 5,272,003 and U.S. Pat. No. 5,318,734, the entire disclosures of which are incorporated herein by reference.

As noted previously, a preferred practice in forming polypropylene fibers has been to produce the fibers from stereoregular isotactic polypropylene produced by supported Ziegler-Natta catalysts, that is, catalysts such as zirconium or titanium tetrachloride supported on crystalline supports such as magnesium dichloride. An alternative procedure has been to use syndiotactic polypropylene, which as described previously, is characterized as having a high content of racemic pentads as distinguished from the meso pentads of isotactic polypropylene.

Canadian Patent Application No. 2,178,104 discloses propylene polymers prepared in the presence of isospecific catalysts incorporating heavily substituted bis(indenyl) ligand structures and the use of such polymers in forming biaxially-oriented polypropylene films. As described in the Canadian application, the polymers used have a very narrow molecular weight distribution, preferably less than three, and well-defined uniform melting points. In each case the ligand structures are substituted on both the cyclopentyl portion of the indenyl structure (at the 2 position), and also on the aromatic portion of the indenyl structure. The tri-substituted structures appear to be preferred, and less relatively-bulky substituents are used in the case of 2-methyl, 4-phenyl substituted ligands or the 2-ethyl, 4-phenyl substituted ligands.

The present invention can be carried out with isotactic polypropylene prepared in the presence of metallocenes, as disclosed in the Canadian Peiffer patent application. Alternatively, the present invention may be carried out by employing a polypropylene produced by an isospecific metallocene based upon an indenyl structure which is monosubstituted at the proximal position and otherwise unsubstituted, with the exception that the indenyl group can be hydrogenated at the 4, 5, 6, and 7 positions. Thus, the ligand structure may be characterized by racemic silyl-bridged bis(2-alkylindenyl) or a 2-alkyl hydrogenated indenyl as indicated by the following structural formulas.

(6)

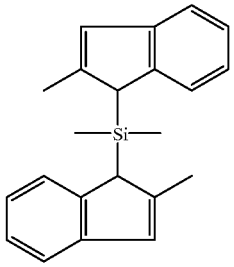

-continued (7)

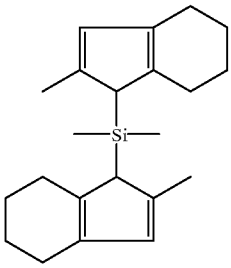

Mixtures of mono- and poly-substituted indenyl-based metallocenes may be used in producing the polymers used in the present invention. Poly-substituted indenyl-based metallocenes may be employed in conjunction with the mono-substituted indenyl structures shown above. In this case, at least 10% of the metallocene catalyst system should comprise the mono-substituted bis(indenyl) structure. Preferably, at least 25% of the catalyst system comprises the mono-substituted bis(indenyl) metallocene. The remainder of the catalyst system can include polysubstituted indenyl-based metallacencos.

The polypropylene employed in the present invention can be one having a relatively non-uniform melt temperature. While having a high isotacticity is defined in terms of meso pentads and meso diads, the polymers also have irregularities in the polymer structure characterized in terms of 2,1 insertions, as contrasted with the predominant 1,2 insertions characteristic of isotactic polypropylene. Thus, the polymer chain of the isotactic polypropylene employed in the present invention are characterized by intermittent head-to-head insertions to result in a polymer structure as exemplified below.

(8)

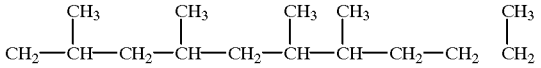

As shown by the polymer structure depicted by Formula (8), the occasional head-to-head insertion resulting from the use of the 2-alkyl substituted indenyl group results in adjacent pendant methyl groups separated by ethylene groups, resulting in a polymer structure which behaves somewhat in the fashion of a random ethylene propylene copolymer and results in a variable melting point. This results in a polymer which can be advantageously-employed to produce fibers having good characteristics in terms of mechanical properties and machine operation, including machine speed.

As indicated by Formula (5) above, the silyl bridge can be substituted with various substituents in which R' and R" are each independently a methyl group, an ethyl group, a propyl group (including an isopropyl group), and a butyl group (including a tertiary butyl or an isobutyl group). Alternatively, one or both of R', R" can take the place of a phenyl group. Preferred bridge structures for use in carrying out the present invention are dimethylsilyl, diethylsilyl, and diphenylsilyl structures.

The Ri substituent at the 2 position (the proximal position with regard to the bridge head carbon atom) can be a methyl, ethyl, isopropyl, or tertiary butyl. Preferably, the substituent at the 2 position is a methyl group. As noted previously the indenyl group is otherwise unsubstituted except that it may be a hydrogenated indenyl group. Specifically, the indenyl ligand preferably will take the form of a 2-methyl indenyl or a 2-methyl tetrahydrol indenyl ligand corresponding to structural Formulas (6) and (7) above. As will be recognized by those skilled in the art, the ligand structure should be a racemic structure in order to provide the desired enantiomorphic site control mechanism to produce the isotactic polymer configuration.

As described previously, the 2,1 insertions characteristic of the polymer used in the present invention produce "mistakes" in the polymer structure. The "mistakes" due to the 2,1 insertions should not, however, be confused with mistakes resulting in racemic insertions as indicated, for example, by the following polymer structure:

(9)

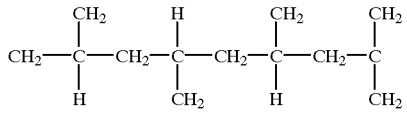

As will be recognized, the structure (9) can be indicated by the pentad mrrm. The "mistakes" corresponding to the head-to-head insertion mechanism involved in the polymers employed in the present invention are not characterized by or are not necessarily characterized by racemic diads.

The process of melt spinning of polypropylene can be termed as non-isothermal crystallization under elongation. The rate of crystallization in this process is highly influenced by the speed of spinning. In the commercial production of bulk continuous filament (BCF) fibers, there is an integrated two-step process involving the initial spinning step and the subsequent drawing step. This gives the fibers the required mechanical properties such as tenacity and elongation. In the past, attempts have been made to eliminate this integrated two-step process and substitute it with a single-step high speed spinning. It was expected that the high speed spinning will incorporate enough orientation in the fiber to give a high tenacity and modulus. This expectation was not met as disclosed in Ziabicki, "Development of Polymer Structure in High Speed Spinning," Proceedings of the International Symposium on Fiber Science and Technology, ISF-85, I-4, 1985. As discussed there, in studying PET fibers, this is mainly due to the high-speed spun fibers exhibiting a high degree of crystallinity and crystal orientation rather than amorphous orientation. The high entanglement in the amorphous orientation prevents sliding of the long molecules when strained giving the fiber a high tenacity.

In experimental work respecting the invention, three isotactic polypropelene polymers, two produced by metallocene catalysis and one by catalysis with a supported Ziegler-Natta catalyst subjected to high speed spinning and drawing, were studied to confirm the capability of the metallocene-based polymers to perform at a higher level than currently involved in spinning fibers such as carpet fibers. During the fiber-forming operation, the polymer is fully amorphous in the melt state, partially oriented during the draw down state, and highly oriented during cold drawing. In the experimental work, changes in molecular structure in the post-spun fibers were analyzed using wide angle x-ray scattering (WAXS) in conjunction with differential scanning calorimetry (DSC) and were used to trace the crystallinity changes in the polymer during the various processing stages.

The two metallocene-based isotactic polypropylenes (MIPP-1 and MIPP-2) and the Ziegler-Natta-based isotactic polypropylene (ZNPP-1) were used to prepare melt spun yarns on a Fourne fiber spinning machine. Both partially oriented yarn (POY) and fully oriented yarn (FOY) were prepared. The polymer MIPP-1 was commercially available isotactic polypropylene produced by metallocene catalyst (referred to herein as "Catalyst A") thought to be based upon a bridged bis(indenyl) ligand of enantiomorphic configuration. The isotactic polymer MIPP-2 was prepared by catalysis with dimethyl silyl bis (2-methyl indenyl) zirconiom dichloride (referred to herein as "Catalyst B").

The polymer pellet samples were characterized by DSC. A temperature scan was performed from 50° C. to 200° C. and after keeping the sample at 200° C. at 5 min, cooled down to 50° C. and then heated to 200° C. All the heating and cooling were done at the rate of 10° C./min. WAXS patterns were obtained on a Siemens Diffraktometer, operating at 50 kW and 40 millamps. The measurements were performed in the reflection mode for scattering angles 2θ between 5° and 35° with a step scanning rate of 0.08°/sec and a counting time of 8 sec at each step. A Ni-filtered copper target x-ray tube emitting the characteristic CuKα radiation with wavelength λ=1.54 A was used. The data were obtained with the diffraction taken along the fiber axis (meridional scans).

The melt spinning and drawing operations were carried out using a trilobal spinnerette with 60 holes (0.3/0.7 mm). The fiber was quenched at 2.0 mBar with cool air at 10° C. The godet temperatures were maintained at 120° C. for the spin godet (G1) and at at 100° C. at the second godet (G2). Spinning was performed at a melt temperature of 230° C. for the Zieglar Natta based polypropylene and at 195° C. for the metallocene-based polymers. Samples were collected at a constant linear density of 5 dieners per fiber (dpf) by varying the spin pump speed and winder speed accordingly. In the experimental work two-step spinning and drawing were retained while progressively increasing the speed of the overall process. The draw speed was initially at 2000 m/min and increased in increments of 500 m/min while maintaining the draw ratio constant at 3:1. This may be contrasted with normal commercial operation in which the spin and draw speeds are about 500 m/min and 1500 m/min respectively to provide a draw ration of 3:1. The limitations of the material would determine the extent to which the draw speed can be increased. In the experimental work both the godets and the Barmag winder in the Fourne fiber line have a maximum speed of 6000 m/min.

A schematic presentation of the various combinations of spinning and drawing conditions used for polypropylene fibers is shown in FIG. 1 in which the draw ratio is placed on the ordinate versus the draw speed in metors per minute on the abscissa. At high spinning speeds, for example, 5000 m/min with no draw as indicated by data point 2, there is not enough orientation to give good mechanical properties. At low spinning speeds with high draw ratio, for example, 200 m/min with 5:1 draw ratio as indicated by data point 4, the mechanical properties have already reached a maximum, and further drawing only deteriorates the fiber properties. A spinning speed of 500 m/min and 3:1 draw ratio as indicated by data point S is commonly used in commercial operations and provides good mechanical properties. By using the same draw ration but increasing the draw speed to 4000 m/min as indicated by point 6 substantially higher productivity can be attained. In the experimental work reported below, the 3:1 draw ratio was kept constant, and the take up speed increased starting from 2000 m/min up through 4000 m/min.

As shown by the following experimental work, much higher productivities were achievable by spinning at higher than normal commercial rates, while at the same time drawing at high rates was achieved, in accordance with the present invention, without deleteriously impacting the mechanical properties of the fibers. In some cases, as discussed below, the spinning and drawing of a metallocene-based polypropylene, in accordance with the present invention, resulted in substantially better mechanical properties than attained through prior art practices.

Figure 2:
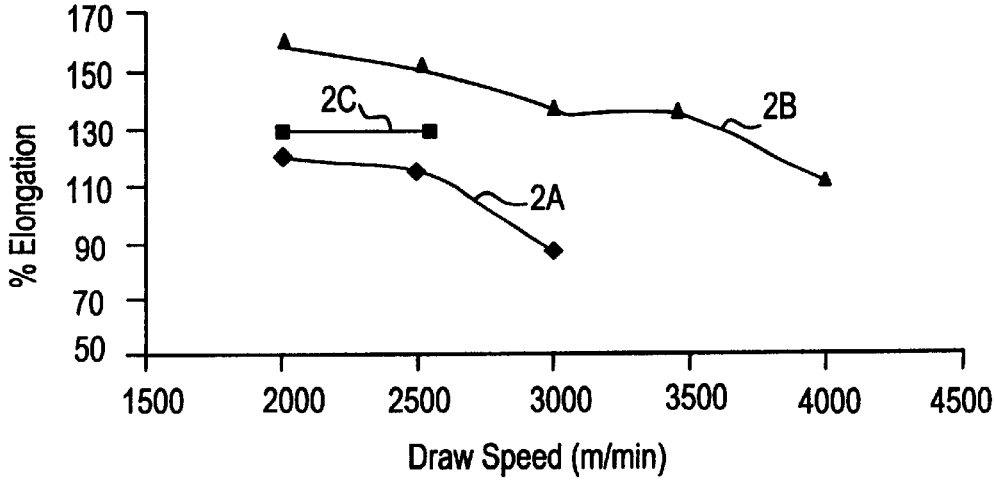
FIG. 2 is a graphical presentation of elongation on the ordinate versus draw speed on the abscissa for polypropylene prepared by catalysis with metallocene catalyst and a Ziegler-Natta catalyst.
Figure 3:
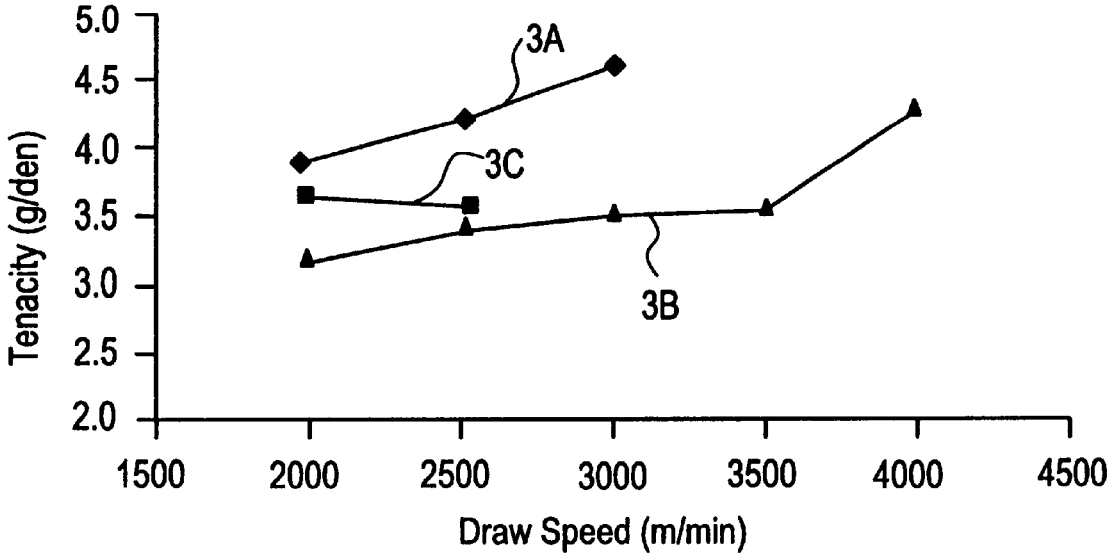
FIG. 3 is a graph of a tenacity on the ordinate versus draw speed on the abscissa for the three polymers depicted in FIG. 2.
Figure 4:
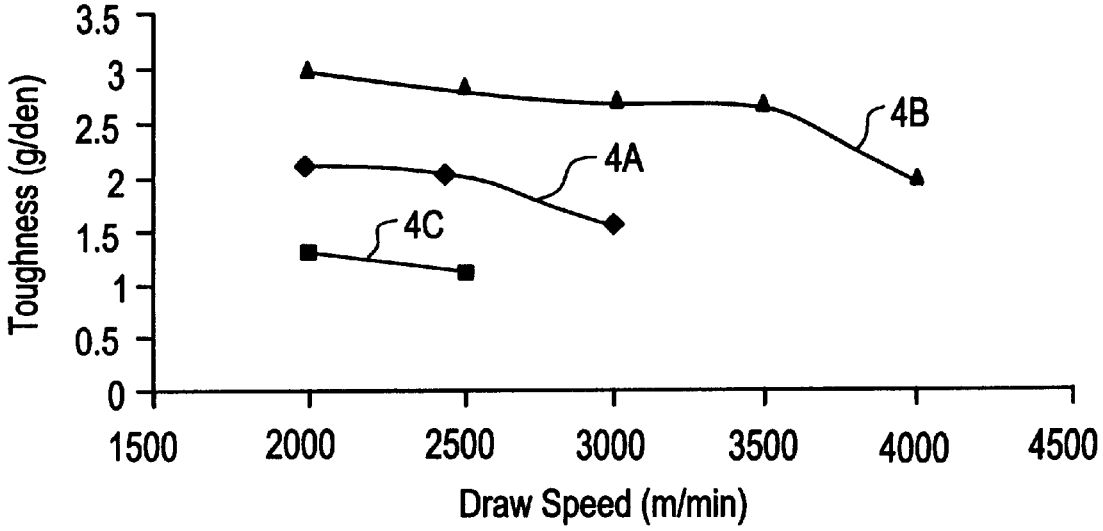
FIG. 4 is a graph showing specific toughness on the ordinate versus draw speed on the abscissa for the three polymers depicted in FIG. 2.

When a semicrystalline polymer is drawn into highly oriented state, its tenacity and modulus increases, but at the same time its elongation to break decreases. This happens in varying degrees depending on the crystallization behavior of the polymer. In the experimental work, it was possible to draw Ziegler-Natta polyproplene up to 2500 m/min, the MIPP-1 polymer up to 3000 m/min, and the MIPP-2 polymer up to 4000 m/min. Hence, the final draw speeds for the miPP polymers were higher than for the ZNPP polymer. It should be emphasized that the spinning and drawing speeds limitations for these materials are for only 5 deniers per fiber (dpf) filaments. At higher dpf these limitations may be different. For example, in the range of 20–30 dpf which is typically used in carpet applications, it may be possible to draw the fibers at a higher speed. This assumes that as the thickness of each fiber increases, it is less likely to break during drawing. The tensile test results for the three fibers are given in FIGS. 2–4, which are plots of % elongation, (FIG. 2) tenacity in grams per denier, FIG. 3 and tenacity in grams/denier, FIG. 4 on the ordinate versus draw speed in meters/minute on the abscissa. The data for the polymers, MIPP-1 and MIPP-2, are indicated by reference characters A & B, respectively, and for the Ziegler-Natta polypropylene by reference character C, in each case prefixed by the figure number. Thus, the data for the metallocene polymers MIPP-1 and MIPP-2 are shown by curves 2A and 2B, respectively, and for the Ziegler-Natta polypropylene by curve 2C. As shown in FIG. 2 (elongation vs. draw speed), the polymer MIPP-2 (curve 2B) shows higher elongation across the range of draw speeds than polymers ZNPP and MIPP-1. In FIG. 3 (tenacity vs. draw speed), it can seen that MIPP-1 shows a higher tenacity followed by ZNPP and MIPP-2. While the tenacities of the two metallocene-based polymers, as indicated by curves 3A and 3B, increase with draw speed, the tenacity of the Ziegler-Natta-based polymer (curve 3C) decreases with draw speed. The specific toughness, measured by integrating the area under the tenacity vs. strain curve, is shown in FIG. 4. Both of the metallocene-based polymers show higher toughness compared to the Ziegler-Natta polymer, with MIPP-2 being the highest.

Figure 5:
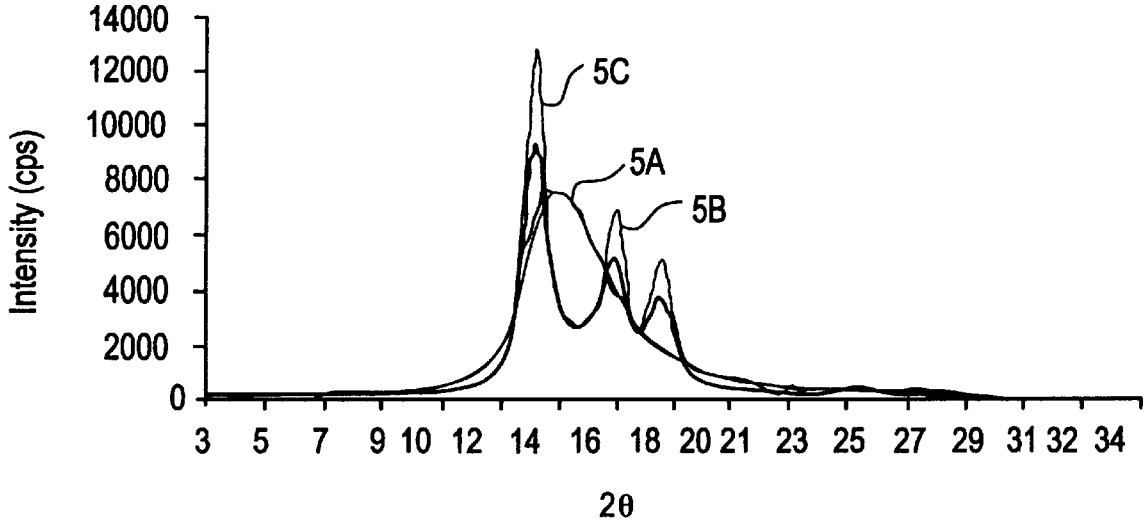
FIG. 5 presents a comparison of wide angle x-ray scattering (WAXS) patterns for fibers formed of the polymers depicted in FIG. 2 at 2,500 meters per minute.
Figure 6:
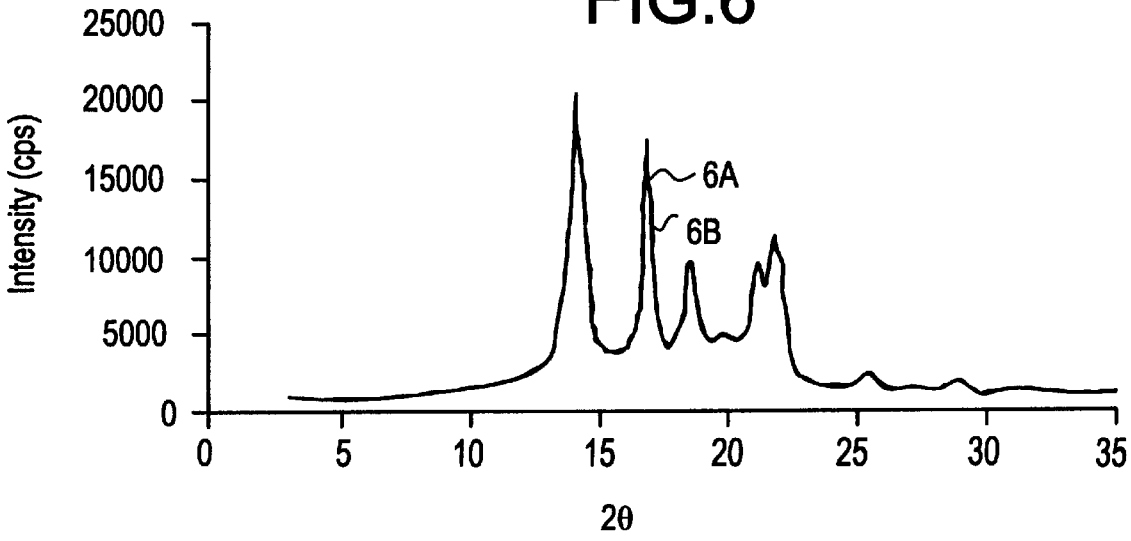
FIG. 6 illustrates WAXS patterns for the two polypropylene-based polymers of FIG. 2 in the quiescent state.

FIGS. 5–9 are graphs of various wide-angle diffraction patterns for fibers spun from the two metallocene-based polymers and the Ziegler-Natta-based polymers. In each of the FIGS. 5–9, the intensity in counts per second (CPS) is plotted on the ordinate versus the diffraction angle 2Θ on the abscissa. In FIGS. 5 and 6, the same convention as used before is used to designate fibers drawn from the two metallocene-based polymers and in FIG. 5 also for the Ziegler-Natta polypropylene.

An examination of the x-ray diffraction patterns for the samples collected at various take-up speeds shows that the pattern for each sample did not change with take-up speed. FIG. 5 shows the plots of intensity in Counts per second (Cps) plotted on the abscissa for the three samples collected at 2500 m/min. Curve 5A, representing polymer MIPP-1, does not show any distinct peaks but a single broad peak. The curves 5B and 5C, for polymers MIPP-2 and ZNPP, respectively, show three distinct peaks with the peaks for the polymer ZNPP being higher and sharper. The MIPP-1 diffraction pattern of curve 5A shows an amorphous nature, and MIPP-2 and ZNPP patterns show crystalline peaks. These results clearly indicate that crystallization and orientation characteristics for the three polymers are quite different. Hence, the differences in their mechanical properties as shown in FIGS. 2–4.

Figure 7:
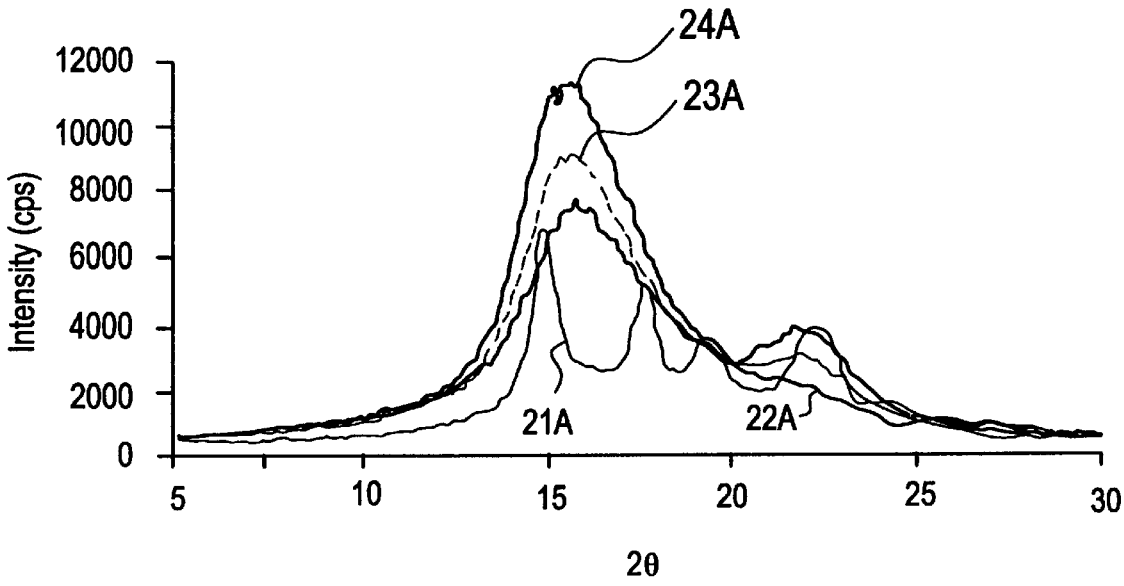
FIG. 7 illustrates WAXS patterns for a metallocene-based polypropylene spun at various speeds.
Figure 8:
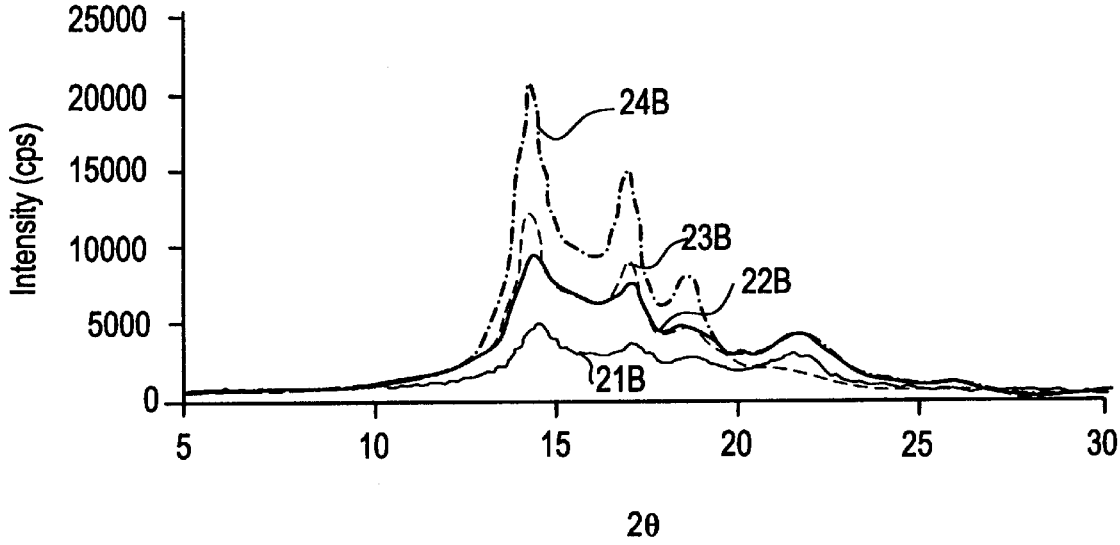
FIG. 8 is a graphical presentation of WAXS patterns for another metallocene-based polypropylene spun at various speeds.
Figure 9:
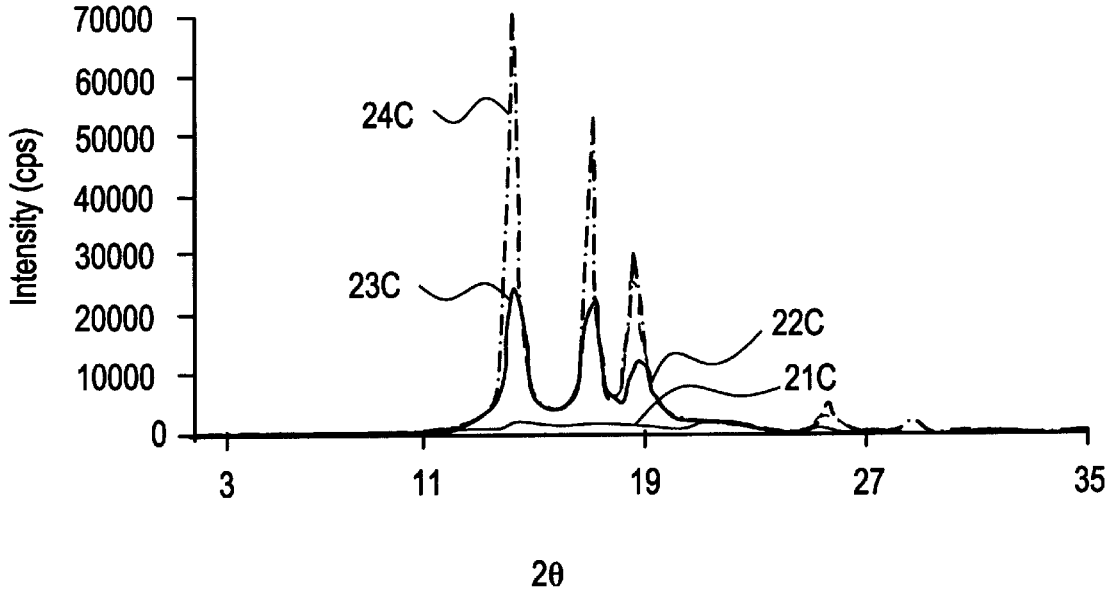
FIG. 9 is a WAXS pattern for a Ziegler-Natta-based polypropylene spun at different speeds.

To further investigate the crystallization behaviors of the three polymers in detail, their diffraction patterns at very low speeds (gravity), 200 m/min, 500 m/min, and 1000 m/min, were observed without subjecting them to drawing. To understand crystallization behavior at the quiescent conditions, diffraction patterns were also taken at the quenched state. The intensity versus 20 graphs are presented in FIGS. 7–9. In FIG. 7, the diffraction patterns observed for the metallocene-based polypropylene, designated as MIPP-1, at gravity and at spinning speeds of 200, 500, and 1,000 meters per minute are indicated by curves 21A, 22A, 23A, and 24A, respectively. In FIG. 8, the corresponding curves for the metallocene-based polymer, designed as MIPP-2, are indicated by curves 21B (gravity), and 22B, 23B, and 24B for spinning speeds of 200, 500, and 1,000 meters per minute. The same data is shown in FIG. 9 for the Ziegler-Natta-based polypropylene with curves 21C, 22C, 23C, and 24C indicating the intensity for gravity conditions and for spinning speeds of 200, 500, and 1,000 meters per minutes, respectively. An examination of MIPP-1 and MIPP-2 diffraction patterns under normal quenching conditions in FIG. 6 shows that the two metallocene-based miPP's crystallize under similar morphological forms ( and $\gamma$ forms with $\gamma$ at $2\theta=19.9°$). However, the diffraction patterns thereafter, with increasing orientations, are quite different for each sample. FIG. 7 shows that for the polymer MIPP-1, with progressively higher spin speeds, the first three strong 1–5 reflections (peaks) merge into a single broad peak, and the reflection at $2\theta=21.4°$ gets weaker in intensity. Deconvolution of the peaks reveal that the polymer MIPP-1, as the spin speed increases, becomes more amorphous. Referring to FIG. 5, it can be said that orientation in the MIPP-1 sample is mainly amorphous. A similar deconvolution of the peaks for polymer MIPP-2 in FIG. 8 shows that the three reflections ($2\theta=14.2$, 16.9 and 18.6°) becomes sharper with increasing spin speed. The amorphous content also increases with speed. FIG. 9 shows that the crystalline content of the Ziegler-Natta polypropylene increases with spin speed and the amorphous content is very small.

As noted previously, the mono-substituted indenyl ligand structures of the present invention may be used alone or in admixture with one or more poly-substituted bis(indenyl) ligands. Particularly useful di-substituted bis(indenyl) metallocenes which may be used in the present invention include those which are substituted at the 4 position as well as at the 2 position. The substituents at the 2 position on the indenyl group are as previously described with ethyl or methyl being preferred and the latter being especially preferred. The substituents at the 4 positions on the indenyl groups are normally of greater bulk than the alkyl groups substituted at the 2 position and include phenyl, tolyl, as well as relatively bulky secondary and tertiary alkyl groups. Thus, the 4 substituent radicals normally have a high molecular weight than the 2 substituent radicals. Thus, where the 2 substituent is a methyl or ethyl group, the substituents at the 4 position may take the form of isopropyl or tertiary butyl groups as well as aromatic groups. As noted previously, it often will be preferred to employ, in combination with the mono-substituted indenyl groups, such as dimethylsilyl, bis(2-methyl indenyl) zirconium dichloride, a di-substituted metallocene having an aryl group at the 4 position. Particularly preferred in combination with the dimethylsilyl bis(2-methyl indenyl) zirconium dichloride is a corresponding dimethylsilyl bis(2-methyl, 4-phenyl indenyl) zirconium dichloride. Tri-substituted bis(indenyl) compounds may also be employed. Specifically, racemic dimethylsilyl bis(2-methyl, 4,6 diphenyl indenyl) zirconium dichloride may be used in combination with the silyl bis(2-methyl indenyl) derivative.

The metallocene or metallocene mixture catalyst systems employed in the present invention are used in combination with an alumoxane co-catalyst as will be well understood by those skilled in the art. Normally, methylalumoxane will be employed as a co-catalyst, but various other polymeric alumoxanes, such as ethylalumoxane and isobutylalumoxane, may be employed in lieu of or in conjunction with methylalumoxane. The use of such co-catalysts in metallocene-based catalyst systems are well-known in the art, as disclosed, for example, in U.S. Pat. No. 4,975,403, the entire disclosure of which is incorporated herein by reference. So-called alkylaluminum co-catalysts or scavengers are also normally employed in combination with the metallocene alumoxane catalyst systems. Suitable alkylaluminum or alkylaluminum halides include trimethyl aluminum, triethylaluminum (TEAL), triisobutylaluminum (TIBAL), and tri-n-octylaluminum (TNOAL). Mixtures of such co-catalysts may also be employed in carrying out the present invention. While trialkylaluminums will usually be used as scavengers, it is to be recognized that alkylaluminum halides, such as diethylaluminum chloride, diethylaluminum bromide, and dimethylaluminum chloride, or dimethylaluminum bromide, may also be used in the practice of the present invention.

While the metallocene catalysts employed in the present invention can be used as homogeneous catalyst systems, preferably they are used as supported catalysts. Supported catalyst systems are well-known in the art as both conventional Zeigler-Natta and metallocene-type catalysts. Suitable supports for use in supporting metallocene catalysts are disclosed, for example, in U.S. Pat. No. 4,701,432 to Welborn, and include talc, an inorganic oxide, or a resinous support material such as a polyolefin. Specific inorganic oxides include silica and alumina, used alone or in combination with other inorganic oxides such as magnesia, titania, zirconia, and the like. Other support for metallocene catalysts are disclosed in U.S. Pat. No. 5,308,811 to Suga et al and U.S. Pat. No. 5,444,134 to Matsumoto. In both patents the supports are characterized as various high surface area inorganic oxides or clay-like materials. In the patent to Suga et al, the support materials are characterized as clay minerals, ion-exchanged layered compounds, diatomaceous earth, silicates, or zeolites. As explained in Suga, the high surface area support materials should have volumes of pores having a radii of at least 20 angstroms. Specifically disclosed and preferred in Suga are clay and clay minerals such as montmorillonite. The catalyst components in Suga are prepared by mixing the support material, the metallocene, and an organoaluminum compound such as triethylaluminum, trinethylaluminum, various alkylaluminum chlorides, alkoxides, or hydrides or an alumoxane such as methylalumoxane, ethylalumoxane, or the like. The three components may be mixed together in any order, or they may be simultaneously contacted. The patent to Matsumoto similarly discloses a supported catalyst in which the support may be provided by inorganic oxide carriers such as $SiO_2$, $Al_2O_3$, MgO, $ZrO_2$, $TiO_2$, $Fe_2O_3$, $B_2O_2$, CaO, ZnO, BaO, $ThO_2$ and mixtures thereof, such as silica alumina, zeolite, ferrite, and glass fibers. Other carriers include $MgCl_2$, $Mg(O\text{-}Et)_2$, and polymers such as polystyrene, polyethylene, polypropylene, substituted polystyrene and polyarylate, starches, and carbon. The carriers are described as having a surface area of 50–500 $m^2/g$ and a particle size of 20–100 microns. Supports such as those described above may be used. Preferred supports for use in carrying out the present invention include silica, having a surface area of about 300–800 $m^2/g$ and a particle size of about 5–10 microns. Where mixtures of metallocenes are employed in formulating the catalyst system, the support may be treated with an organoaluminum co-catalyst, such as TEAL or TIBAL, and then contacted with a hydrocarbon solution of the metallocenes followed by drying steps to remove the solvent to arrive at a dried particulate catalyst system. Alternatively, mixtures of separately supported metallocenes may be employed. Thus, where a mixture of metallocenes are employed, a first metallocene, such as racemic dimethylsilyl bis(2-methyl indenyl) zirconium dichloride, may be supported on a first silica support. The second di-substituted metallocene, such as racemic dimethylsilyl bis(2-methyl, 4-phenyl indenyl) zirconium dichloride, can be supported on a second support. The two quantities of separately supported metallocenes may then be mixed together to form a heterogeneous catalyst mixture which is employed in the polymerization reaction.

By reference to the foregoing discussion of experimental work, it will be recognized that the single site iso specific metallocene catalyst employed in accordance with the present invention can be used to control the structure of the isotactic polymers used in the fiber spinning process. The nature of the polymers in terms of molecular weight distribution isotacticity is determined by NMR analysis so the polymers can be used to determine the mechanical properties of the polymers of the fibers. The fiber properties in turn can be controlled by the fiber spinning kinetics in terms of draw speed, draw ratio and spinning speed in conjunction with the polymer structure.

These relationships can be used to advantage in the operation of a commercial fiber production system by varying the fiber production kinetics in a two-step spinning procedure in order to vary the fiber characteristics. Thus, the draw speed can be varied within a desired range, preferably within the range of 2,000–5,000 meters per minute and more preferably within the range of 3,000–4,000 meters per minute while concomitantly varying the spin speed in order to maintain the draw ratio constant. Thus, when employing a draw ratio of 3:1, which is typical for commercial operations, the spinning speed in the preferred range can vary from 1,000 meters per minute (corresponding to a draw speed of 3,000 meters per minute) to a spinning speed of about 1,500 meters per minute (corresponding to a draw speed of 4,500 meters per minute).

As can be seen, the use of isotactic polymers produced by the isospecific metallocenes employed in the present invention enable the fiber spinning process to be tailored to the desired fiber characteristics. Concomitantly, when varying the kinetics of the fiber spinning procedure, the polymers supplied to the spinning machine cannot be varied in terms of the isospecific metallocene used to prepare the isotactic polymer. For example, as shown by the foregoing experimental work, the polymer produced by the isospecific metallocene, identified above as Catalyst B, produces the best tenacity value for the fibers at a high draw speed of 4,000 meters per minute at a draw ratio of 3 to 1. This high draw speed is, of course, consistent with high productivity and also produces good fiber toughness, about 2 grams per denier. The highest elongation is attained with the polymer MIPP-2 produced by Catalyst B. In carpet fibers 100% elongation is considered good.

The isotactic polypropylene used in the present invention preferably has a narrow molecular weight distribution within the range of 2–3. The molecular weight distribution can, in turn, be controlled through the designation of a particular isospecific metallocene in the polymerization procedure. Thus, molecular weight distributions near the upper end of the range generally produce best results in terms of elasticity, as determined by percent elongation, and in terms of mechanical strength, as determined by specific toughness across a broad range of draw speeds when contrasted with polymers of a lower molecular weight distribution, such as those produced by Catalyst A identified above. On the other hand, polymers produced by Catalyst A show the best maximum tenacities at the draw speeds near the lower end of the desired range.

As noted above, the isotacticity of the polymer can be controlled by appropriate selection of the isospecific metallocene. It will be preferred, in carrying out the present invention, to employ a polymer having an isotacticity of at least 90% as determined by the meso pentad of at least 90%. The polymer should have meso diads of at least 95% with a correspondence in racemic diads being 5% or less. Moreover, the polymers preferably have 2,1 insertion errors, as described previously, of about 1% or slightly above as indicated by the polymers produced by Catalyst A. The melt temperature of the polymer increases with the decreasing 2,1 insertions. As a practical matter, it is preferred to employ polymers having 2,1 insertion errors of at least 0.5%.

From the foregoing description, it will be recognized that the fiber-forming operation can be modified in terms of the isotactic polypropylene and its polymerization catalyst and in terms of the fiber spinning parameters to produce fibers of desired physical characteristics during one mode of operation and of another desired physical characteristic or characteristics during another mode of operation. Parameters which can be varied include draw speed and spin speed over desired ranges while maintaining the draw ratio constant or varying the draw ratio in order to impact parameters such as percent elongation and toughness. Similarly, in the course of the fiber spinning operation, a change may be made from one polymer to another (distinguishable in terms of the metallocene catalyst used in the polymerization of the propylene) to impact such physical parameters of the fibers while maintaining the draw speed and/or the draw ratio constant or while varying these fiber spinning parameters, as well as the polymers supplied to the fiber spinning system. As indicated by the experimental data, the use of propylene polymers prepared with the metallocene catalysts of the type characterized by Formula (5) above to provide substantial 2,1 insertion errors, is particularly desirable in terms of producing good elongation characteristics along a wide range of draw speeds and specific toughness over a wide range of draw speeds. Even within this parameter, however, several polymers can be used, prepared by catalyst systems which can be modified as described previously to incorporate both 2-substituted bis(indenyl) ligands as well as polysubstituted bis(indenyl) ligands.

Having described specific embodiments of the present invention, it will be understood that modifications thereof may be suggested to those skilled in the art, and it is intended to cover all such modifications as fall within the scope of the appended claims.

What is claimed:

1. In an elongated fiber product, the combination comprising a drawn polypropylene fiber prepared from an isotactic polypropylene containing at least 0.5% 2,1 insertions polymerized in the presence of a catalyst characterized by the formula:

$$\text{rac-R'R''Si(2-RiInd)}_2\text{MeQ}_2$$

wherein, rac indicates a racemic ligand structure;

R', R" are each independently a $C_1$–$C_4$ alkyl group or an phenyl group,

Ind is an indenyl group or a hydrogenated indenyl substituted at the proximal position by the substituent $R_1$ and being otherwise unsubstituted or substituted at one or two of the 4, 5, 6, and 7 positions, Ri is an ethyl, methyl, isopropyl, or tertiary butyl group, Me is a transition metal selected from the group consisting of titanium, zirconium, hafnium, and vanadium, and each Q is independently a hydrocarbyl group or containing 1 to 4 carbon atoms or a halogen, said fiber being prepared by spinning and drawing at a draw speed of at least 3,000 minutes per minute and a draw ratio of at least 3 and further characterized by having an elongation at break of at least 100% and having a specific toughness of at least 1.5 grams per diener.

2. The fiber product of claim 1 wherein said drawn fiber is prepared from isotactic polypropylene characterized by 2,1 insertions within the range of 0.5–2%.

3. The fiber product of claim 1 wherein said drawn fiber is prepared from isotactic polypropylene characterized by 2–1 insertions of at least 1%.

4. The fiber product of claim 1 wherein said drawn fiber is prepared from isotactic polypropylene having at least 90% meso pentads.

5. The fiber product of claim 1 wherein said drawn fiber is prepared from isotactic polypropylene having at least 95% meso diads.

6. The elongated fiber product of claim 1 wherein said fiber has a specific toughness of at least 2 grams per denier.

* * * * *

UNITED STATES PATENT AND TRADEMARK OFFICE

CERTIFICATE OF CORRECTION

PATENT NO. : 6,146,758
DATED : November 14, 2000
INVENTOR(S) : Mohan R. Gownder, Eduardo E. Zamora and Jay Nguyen It is certified that error appears in the above-identified patent and that said Letters Patent is hereby corrected as shown below:

Column 16,
Line 2, replace "minutes" with -- meters --.

Signed and Sealed this

Twenty-third Day of October, 2001

*Attest:*

Nicholas P. Godici

NICHOLAS P. GODICI
*Acting Director of the United States Patent and Trademark Office*

*Attesting Officer*